US006198826B1

(12) United States Patent
Cowieson et al.

(10) Patent No.: US 6,198,826 B1
(45) Date of Patent: Mar. 6, 2001

(54) QSOUND SURROUND SYNTHESIS FROM STEREO

(75) Inventors: Brian Cowieson; John Arthur, both of Calgary; Terry Cashion, Kensington, all of (CA)

(73) Assignee: QSound Labs, Inc., Calgary (CA)

( * ) Notice: Subject to any disclaimer, the term of this patent is extended or adjusted under 35 U.S.C. 154(b) by 0 days.

(21) Appl. No.: 09/058,047

(22) Filed: Apr. 9, 1998

Related U.S. Application Data

(63) Continuation-in-part of application No. 08/858,586, filed on May 19, 1997.

(51) Int. Cl.[7] ..... H04R 5/00
(52) U.S. Cl. ..... 381/18; 381/19
(58) Field of Search ..... 381/17, 18, 19, 381/22, 21

(56) References Cited

U.S. PATENT DOCUMENTS 4,039,755 * 8/1977 Berkovits ..... 381/27
4,807,217 * 2/1989 Ide ..... 381/22
5,742,687 * 4/1998 Aarts ..... 381/27

FOREIGN PATENT DOCUMENTS 13002 2/1975 (JP) .
116202 9/1977 (JP) .
42495 4/1981 (JP) .
70100 4/1984 (JP) .
9212 1/1985 (JP) .

* cited by examiner

*Primary Examiner*—Minsun Oh Harvey
(74) *Attorney, Agent, or Firm*—Fulbright & Jaworski L.L.P.

(57) ABSTRACT

The inventive mechanism produces multiple output signals from a two-channel stereo input signal. The mechanism produces a first pair of output signals which retain the monaural information in the stereo input signal. The first pair of signals each comprise a combination of one of the input channels and filtered signal produced from a difference of both input channels. The mechanism produces a second pair of output signals which lacks the monaural information. The second pair of output signals each comprise a combination of one of the input channels and an inverse filtered signal produced from a difference of both input channels. Q-filters are used to provide the various filtered signals.

36 Claims, 3 Drawing Sheets

FIG. 2
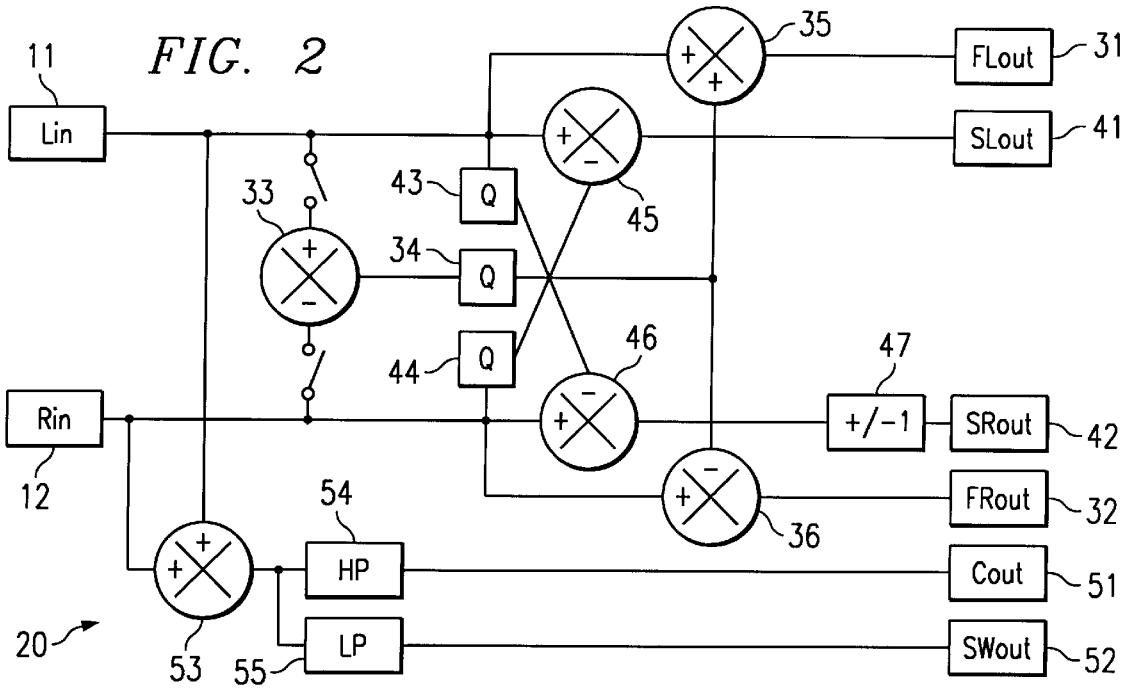
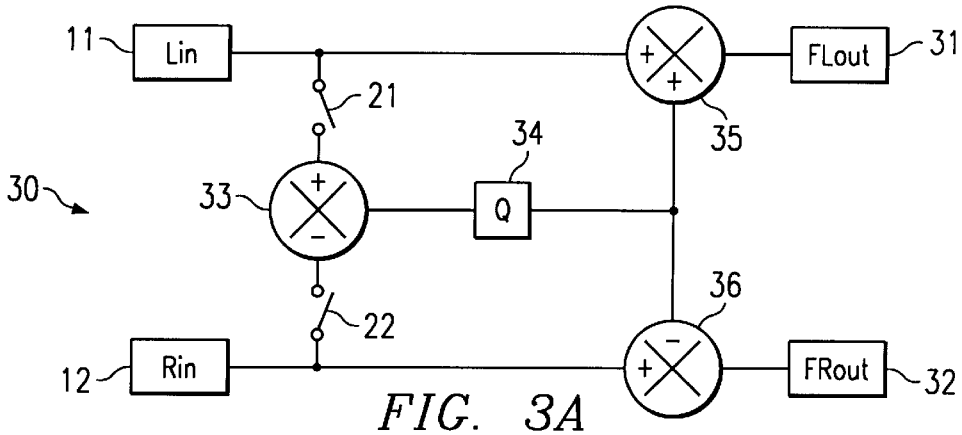
FIG. 3A
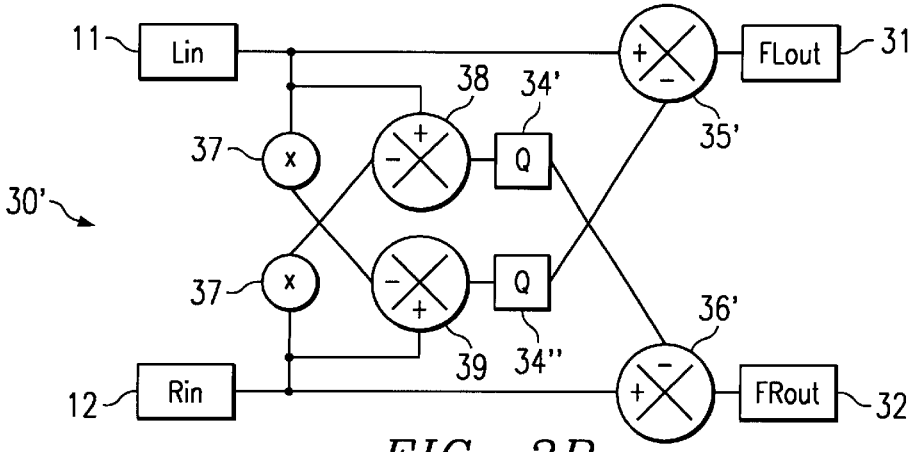
FIG. 3B

QSOUND SURROUND SYNTHESIS FROM STEREO

RELATED APPLICATIONS

The present application is a continuation in part of co-pending and commonly assigned U.S. application Ser. No. 08/858,586, entitled FULL SOUND ENHANCEMENT USING MULTI-INPUT SOUND SIGNALS filed May 19, 1997, which is incorporated herein by reference. The present application is related to co-pending and commonly assigned U.S. application Ser. No. 08/511,788, entitled STEREO ENHANCEMENT SYSTEM INCLUDING SOUND LOCALIZATION FILTERS, filed Aug. 7, 1995, which is incorporated herein by reference, which is a continuation in part of U.S. Pat. No. 5,440,638.

TECHNICAL FIELD OF THE INVENTION

This application relates in general to audio signal processing, and in specific to synthesizing multiple output channels from two-channel, stereo input signals.

BACKGROUND OF THE INVENTION

A recent trend in the audio industry is the purchase and installation of home theater systems. Consumers have been purchasing multiple speaker sound systems which are integrated with a video system which uses VCR tapes and/or DVD disks. A similar trend is occurring in the automobile audio industry, wherein multiple speaker sound systems are being installed in automobiles and trucks.

In both of these cases, the input signal typically comprises a stereo or two-channel signal, which is being outputted on five or more speakers, each of which is capable of receiving a separate channel. Since there are more speakers than signals, the same signal is sent to multiple speakers. Thus, these audio systems are under utilized. Although there are a small number of recorded movies and/or sound CDs that are available, which have been recorded with the full five channel system, the vast bulk of audio/visual (A/V) entertainment information (including music CD's, VHS movies, television broadcasts) is recorded in the stereo or two-channel format.

Such systems typically handle stereo signals by sending the same signal to the front and rear speakers. For example, the front left and rear left speakers would receive the same left input channel. The amplitude of the signal can be controlled through a fader button which defines the portion of the signal going to the front speakers and the portion going the rear speakers. A sub-woofer channel can be created by summing the left and right channels and filtering out the high frequency information. Consequently, the multiple speaker systems are being under utilized when using stereo two-channel A/V information.

Therefore, there is a need in the art for a mechanism which will synthesize multiple channels of audio signals from a two-channel stereo input signal. This would allow an existing multiple channel audio system to output unique synthesized channels to each speaker.

SUMMARY OF THE INVENTION

These and other objects, features and technical advantages are achieved by a system and method which synthesizes multiple output channels or signals from a two-channel stereo signal.

The inventive mechanism uses several sub-systems to generate output signals from the stereo input signals. A first sub-system synthesizes the front left and front right signals, which include monaural information. A second sub-system synthesizes the surround (or rear) left and surround right signals, which have the monaural information canceled or greatly diminished. A third sub-system synthesizes the center signal and the sub-woofer low frequency signal. Thus, using a stereo input signal, the inventive mechanism can synthesize six different output signals. Each of the output signals can be directed to a different speaker.

A technical advantage of the present invention is to allow multiple channel audio systems to utilize their multiple channel capabilities and playback four or more channels synthesized from input materials recorded in two-channel stereo.

Another technical advantage of the present invention is that the center or monaural information is delivered by the front speakers or by a center speaker.

A further technical advantage of the present invention is that the center or monaural information is removed from the rear speakers.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 2 depicts the inventive system which outputs six channels from a two-channel stereo input;

FIGS. 3A and 3B each depict an alternate sub-system of FIGS. 1 and 2 which create the left front and right front output channels;

DESCRIPTION OF THE PREFERRED EMBODIMENTS

Figure 1A:
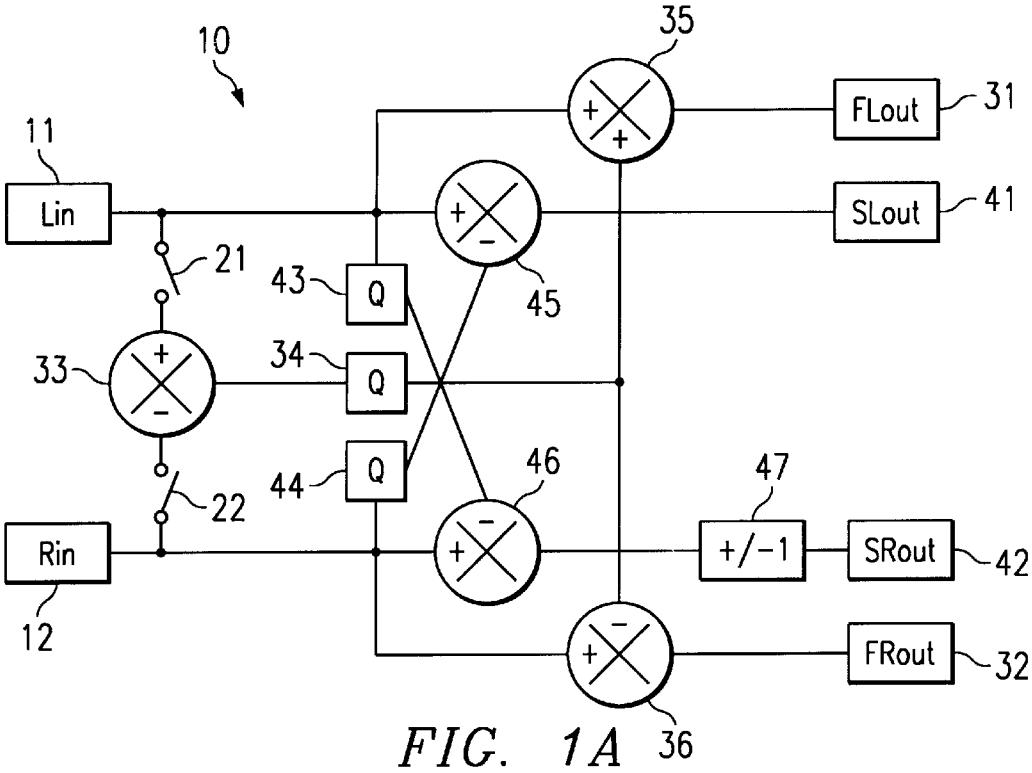
FIGS. 1A and 1B depict the inventive system which outputs four-channels from a two-channel stereo input.

FIG. 1A depicts the inventive arrangement 10 wherein a two-channel stereo input, from an A/V source, is converted into four-channel output signals, each of which can be sent to a different speaker. Left input 11 and right input 12 are sent through summers 35 and 36, respectively, to front left output 31 and front right output 32. FIG. 3 shows this more clearly. Note that summer 36 includes an inverter, however, this inverter could reside within Q-filter 34. Similarly, summers 45 and 46 also are shown to have inverters, however, these inverters could reside with in Q-filters 44 and 43, respectively. Optionally, Q-filter 34 is switched into the circuit 10 by a user via switches 21, 22. A single switch could be placed between Q-filter 34 and summers 35,36 instead of switches 21, 22. The Q-filter 34 could be a QXpander filter, wherein QXpander is a registered trademark of QSound. The QXpander is described in U.S. Pat. No. 5,440,638 to Lowe et al., which is hereby incorporated by reference. The Q-filter 34 could be a Q1 filter, which is described in U.S. Pat. Nos. 5,105,462 and 5,208,860 both to Lowe et al., wherein each of these patents are hereby incorporated by reference. The output of summer 33 is L−R which is inputted into Q-filter 34, which adjusts the amplitude and phase of the signal on a frequency dependent basis. Note that summer 33 includes an invertor on the R input side, however, the invertor does not have to be a part of summer 33, but can be separate from the summer and be applied such that only that portion of the R input side going to summer 33 is inverted. This note applies to the other summers as well. The inversion multiplies the signal by −1, and therefore the polarity of the amplitude is changed. Any positive amplitude becomes negative and any negative amplitude becomes positive. This applies to the other summers as well.

The signal output from Q-filter 34 is then added to L input 11 by summer 35, which results in a (Q{L−R}+L) signal as front left output 31. The signal output of Q-filter 34 is also subtracted from R input 12 by summer 36, and results in (R−Q{L−R}) signal as front right output 32. Note that summer 33 could have the invertor on the L input side, which would require an inverter on summer 35, instead of summer 36, to invert the output from Q-filter 34. Switches 21,22 allow for a user to switch off the Q-filtering on the front channels and to have the Q-filter enhanced signals only on the rear or surround channels, thereby receiving the standard left and right stereo channels in the front speakers.

Each of the output signals 31 and 32 retains monaural or center information. For example, if the same sounds were in both the left and right channels, then an output of L−R would equal zero, because L=R. Therefore no monaural or center information is passed to the Q-filter 34, and the outputs 31 and 32 would be the inputs 11 and 12. This means that the monaural or center information is retained. In today's music, voice and drums tend to be in center information, with guitar and piano to the side information. Thus, the mid-panned or center panned sounds in the recorded mix appear in the front speakers.

Instead of the single Q-filter as shown in FIG. 3A, an arrangement having two Q-filters can be used, as shown in FIG. 3B. As stated earlier, Q-filter could be a QXpander filter, and thus both filters of FIG. 3B could be QXpander filters. A difference of L input signal 11 and R input signal 12 is created by summer 38 and provided to Q-filter 34'. The output of Q-filter 34' is then inverted and added to R input signal 12 by summer 36'. The output from summer 36', R−Q{L−R}, is the R front output signal 32. Note that the R front output signal 32 of FIG. 3B is the same as FIG. 3A. Similarly, a difference of R input signal 12 and L input signal 11 is created by summer 39 and provided to Q-filter 34". The output of Q-filter 34" is then inverted and added to L input signal 11 by summer 35'. The output from summer 35', Q{L−R}+L, is the L front output signal 31. Note that the L front output signal 31 of FIG. 3B is the same as FIG. 3A. FIG. 3B also retains the monaural information. Note that the input signal to each Q-filter, 34' and 34" is either L−R or R−L, if the scale multipliers 37 are set to 1. If the same sounds were in both the left and right channels, then L-R and R-L would equal zero, and thus, monaural information is not processed by the Q-filter, and the outputs of arrangement 30' is merely equal to the respective inputs. The arrangement of FIG. 3B could include switches 21 and 22 as shown in FIG. 3A. FIG. 3B includes scale multipliers 37, each independently operable, for introducing an attenuation in the signal going into the negative input of summers 38 and 39. The scale multipliers control how much monaural or center information is passed to the Q-filters. In the extreme case where the attenuation is set to infinity, there is no signal sent to the summers 38 and 39 from the opposite input signal. Hence, all of the monaural information is passed to the Q-filters. This results is a severe loss of monaural energy at the outputs 31 and 32. The arrangement of FIG. 3B can be substituted for the arrangement of FIG. 3A shown in FIGS. 1 and 2, if the scale multipliers 37 are set to 1. This arrangement will duplicate the effects of FIG. 3A, however the scale multipliers 37 can be adjusted to provide control over the balance of the center information. The arrangement of FIG. 3A can also be fitted with scalers. Note that a scale multiplier could be placed before each of the summers in FIGS. 1A, 1B, 2, 3A, 3B, 4, and 5, and would be used to control the amount of signal energy reaching the summer.

L input 11 is also connected to Q-filter 43 as shown in FIG. 1. This is more clearly shown in FIG. 4. Also, R input 12 is connected to Q-filter 44. Both of these filters may be Q1 filters. The output each Q-filter is subtracted from the opposite input via summers 45 and 46. For example, the output of Q1 filter 44 is subtracted from L input 11 and used as the left rear or surround output 41. Right rear or surround output 42 is similarly formed from the output of Q-filter 43 subtracted from the R input. In this instance the outputs are L-Q{R} for L rear output 41 and R−Q{L} for R rear output 42, and thus the center information is canceled out. If the same sounds were in both the left and right channels, then an output 41 would be nearly zero. This is similar for the right rear output 42. In today's music, voice and drums tend to be in center information, with guitar and piano to the side information. With the center information canceled out, the side-panned sounds in the recorded mix appear dominant in the rear speakers. Therefore, the arrangement of FIG. 1A receives a stereo input signal, 11 and 12, and synthesizes four different output signals, 31, 32, 41, and 42.

Figure 4:
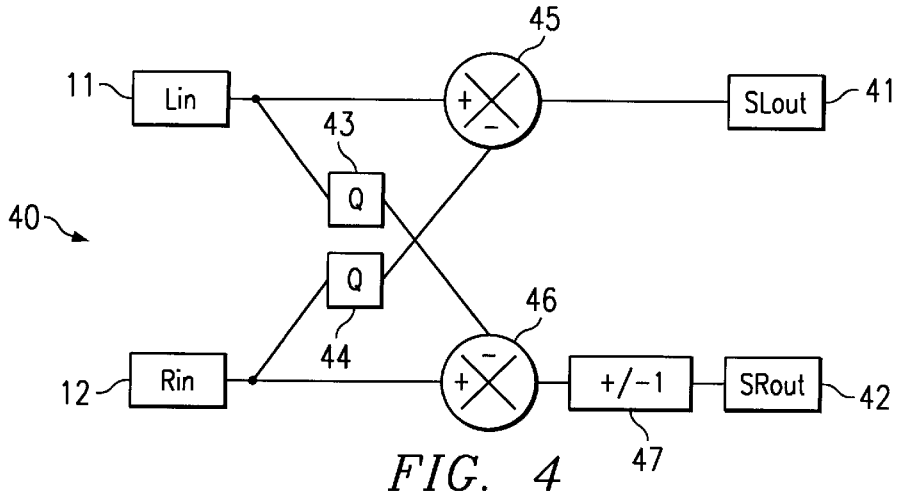
FIG. 4 depicts a sub-system of FIGS. 1 and 2 which creates the left rear and right rear output channels.
Figure 6A:
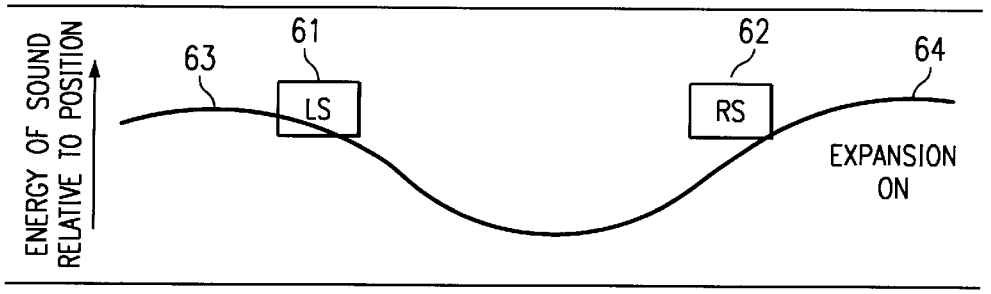
FIGS. 6A and 6B depict the effects a switch in the sub-system of FIG. 4.
Figure 6B:
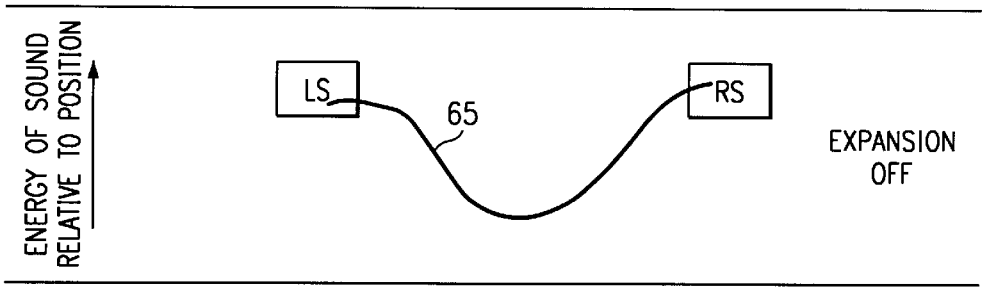

Switch 47 is a user selectable phase inverter following the output of summer 46, which allows the user to turn off the expansion effect of the circuit of FIG. 4. In FIG. 6A the switch is turned on (+1), enabling the expander effect. Note that the portions 63, 64 of sound energy of the signal is spread beyond the locations of the speakers 61 and 62. In FIG. 6B, the switch is turned off (−1), and the energy 65 does not spread beyond the locations of the speakers 61,62. Note that the monaural information is still suppressed, even though the switch is off. Switch 47 could alternatively be placed on the output of summer 45. Note that the Q-filter processed signals are normally inverted between the two output channels. When the R output signal is inverted, the necessary inversion between the two output channels is lost, and hence the virtual image effects are turned off. Switch 46 inverts or reverses the sign of the amplitude of the signal.

The filters of FIGS. 3A, 3B and 4, are all IIR or Infinite Impulse Response type. This type of filter has a feedback loop, which cause the output signal to last longer. The filter could alternatively be of the FIR type or Finite Impulse Response. The Q-filters can be implemented as IIR or FIR filters in digital domain. The Q-filters can also be implemented in the analog domain. The Q-filter in FIG. 3A is preferably a two-stage filter. The Q-filters in FIGS. 3B and 4 are preferably a one-stage filter. However all of the filters could comprise one or more stages.

Figure 1B:
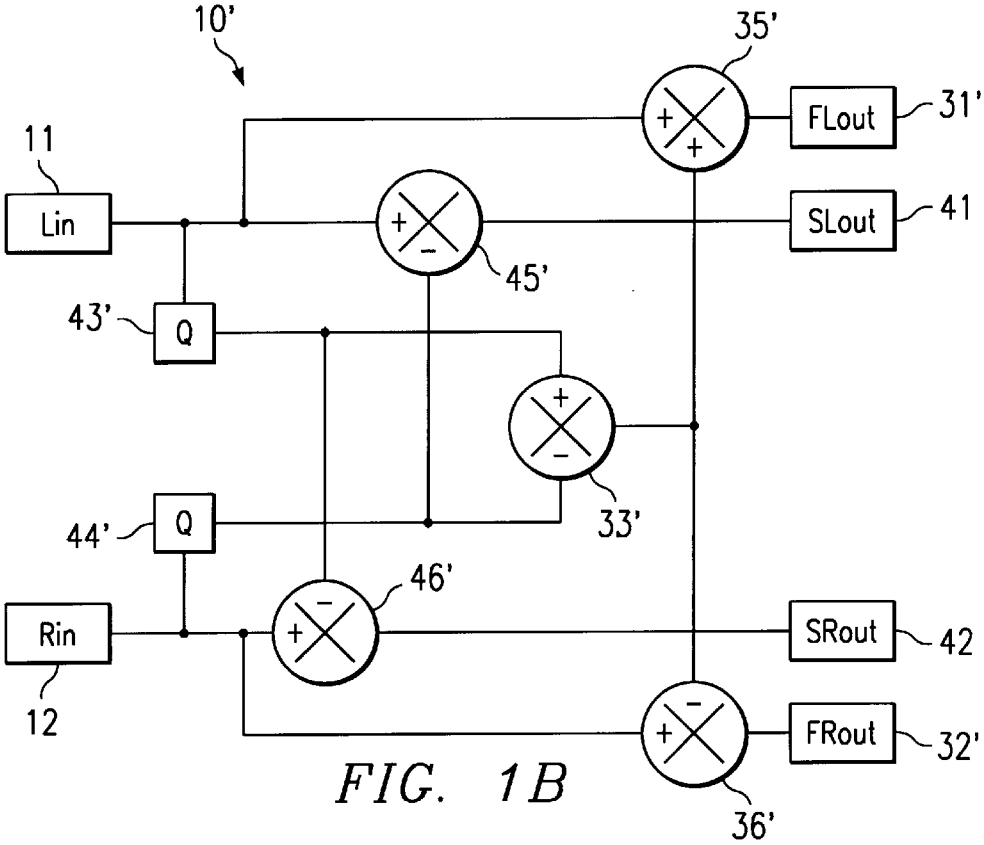

The arrangement 10' of FIG. 1B depicts an alternative to the arrangement of FIG. 1A. However, only two Q-filters are used, 43' and 44'. The outputs of these filters are combined with the input signals by summers 33', 35', 36', 45', and 46' to produce output signals 31', 32' 41, and 42. Note that the output signals 41 and 42 are identical to the output signals 41 and 42 of FIG. 1A, namely L−Q{R} and R−Q{L}, respectively. However, the outputs 31' and 32' appear different than 31 and 32 of FIG. 1A. The output 31' is Q{L}−Q{R}+L, which is different from Q{L−R}+L output 31. However, since the Q-filters are linear, then the Q-function is distributive, and thus Q{L−R} equals Q{L}−Q{R}. Therefore, output 31' is the same as output 31, so long as the Q-filter is operating in a linear fashion. This is also true for output 32' and output 32. The switch 47 appearing in FIG. 1A could also be used in FIG. 1B. A single switch placed between summer 33' and summers 35',36' could be used instead of switches 21 and 22. The arrangement of FIG. 1B could also replace that of FIG. 1A in FIG. 2.

Figure 5:
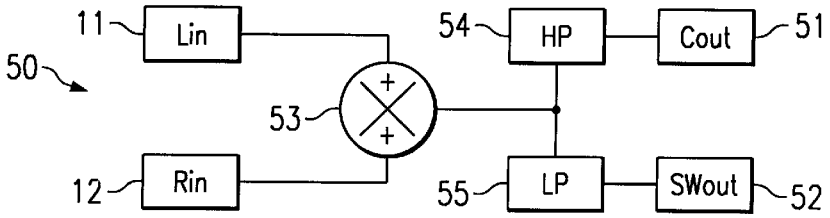
FIG. 5 depicts a sub-system of FIG. 2 which creates the center and sub-woofer output channels.

The arrangements of FIGS. 1A and 1B are better suited to four-speaker sound systems. FIG. 2 depicts the arrangement that is preferable for systems having a center speaker and a sub-woofer. Note that the system of FIG. 2 could be modified for a five speaker system, i.e. having either just a center or a sub-woofer. The sub-systems of FIGS. 3A or 3B, and 4 are present in FIG. 2. Moreover, FIG. 2 includes the sub-system of FIG. 5. In FIG. 5, L input 11 and R input 12 are added together by summer 53, essentially creating a monaural output. The output of summer 53 is filtered by high-pass filter 54 with a cutoff frequency of about 100 Hz, and used as center output 51. The output is also filtered by low-pass filter 55 with a cutoff frequency of about 100 Hz, and used as sub-woofer output 52. Note that the recited cutoff frequencies are by way of example only. Therefore, the arrangement of FIG. 2 receives a stereo input signal, 11 and 12, and synthesizes six different output signals, 31, 32, 41, 42, 51, and 52.

Although the present invention and its advantages have been described in detail, it should be understood that various changes, substitutions and alterations can be made herein without departing from the spirit and scope of the invention as defined by the appended claims.

What is claimed is:

1. A system for synthesizing multiple output channels from a stereo input signal, the system comprising:

first circuit for synthesizing a first pair of output signals having monaural information from the stereo input signal, wherein said first circuit comprises:

a first summer for combining the one channel of the stereo signal with an inverse of the other channel of the stereo signal to form a difference signal;

a first filter for adjusting amplitude and phase of the difference signal on a frequency dependent basis to form a first filtered signal;

a second summer for combining the first filtered signal with the one channel to form one signal of the first pair of output signals; and a third summer for combining an inverse signal of the first filtered signal with the other channel to form the other signal of the first pair of output signals; and second circuit for synthesizing a second pair of output signals having monaural information substantially removed from the stereo input signal.

2. The system of claim 1, further comprising:

third circuit for synthesizing a center monaural signal from the stereo input signal.

3. The system of claim 2, wherein the third circuit comprises:

a fourth summer which combines the stereo input signals to form a first combined signal; and a high pass filter, which is applied to the first combined signal and forms the center monaural signal.

4. The system of claim 1, further comprising:

fourth circuit for synthesizing a sub-woofer signal from the stereo input signal.

5. The system of claim 4, wherein the fourth circuit comprises:

a fourth summer which combines the stereo input signals to form a first combined signal; and a low pass filter, which is applied to the first combined signal and forms the sub-woofer signal.

6. The system of claim 1, wherein said first filter for adjusting comprises:

a first Q-filter.

7. The system of claim 1, further comprising:

module for switchably controlling an operation of said first filter for adjusting.

8. The system of claim 1, wherein the second circuit comprises:

a second filter for adjusting amplitude and phase of the one channel of the stereo signal on a frequency dependent basis to form a second filtered signal;

a third filter for adjusting amplitude and phase of the other channel of the stereo signal on a frequency dependent basis to form a third filtered signal;

a fifth summer for combining an inverse signal of the third filtered signal with the one channel of the stereo signal to form one signal of the second pair of output signals; and a sixth summer for combining an inverse of the second filtered signal with the other channel of the stereo signal to form the other signal of the second pair of output signals.

9. The system of claim 8, wherein:

said second filter for adjusting comprises a second Q-filter; and said third filter for adjusting comprises a third Q-filter.

10. A method for synthesizing multiple output channels from a stereo input signal, the method comprising the steps of:

synthesizing a first pair of output signals having monaural information from the stereo input signal, wherein said step of synthesizing a first pair of output signals comprises the steps of:

combining the one channel of the stereo signal with an inverse of the other channel of the stereo signal to form a difference signal;

adjusting amplitude and phase of the difference signal on a frequency dependent basis to form a first filtered signal;

combining the first filtered signal with the one channel to form one signal of the first pair of output signals; and combining an inverse signal of the first filtered signal with the other channel to form the other signal of the first pair of output signals; and synthesizing a second pair of output signals having monaural information substantially removed from the stereo input signal.

11. The method of claim 10, wherein the step of:

synthesizing a center monaural signal from the stereo input signal.

12. The method of claim 11, wherein the step of synthesizing a center monaural signal comprises the steps of:

combining the stereo input signals to form a first combined signal; and high pass filtering the first combined signal to form the center monaural signal.

13. The method of claim 10, further comprising the step of:

synthesizing a sub-woofer signal from the stereo input signal.

14. The method of claim 13, wherein the step of synthesizing a sub-woofer signal comprises the steps of:

combining the stereo input signals to form a first combined signal; and low pass filtering the first combined signal to form the sub-woofer signal.

15. The method of claim 10, wherein:

the step of adjusting is performed by a first Q-filter.

16. The method of claim 10, further comprising the step of:

switchably controlling a performance of the step of adjusting.

17. The method of claim 10, wherein the step of synthesizing a second pair of output signals comprises the steps of:

adjusting amplitude and phase of the one channel of the stereo signal to form a second filtered signal;

adjusting amplitude and phase of the other channel of the stereo signal to form a third filtered signal;

combining an inverse signal of the third filtered signal with the one channel of the stereo signal to form one signal of the second pair of output signals; and combining an inverse of the second filtered signal with the other channel of the stereo signal to form the other signal of the second pair of output signals.

18. The method of claim 17, wherein:

the step of adjusting amplitude and phase of the one channel is performed by a second Q-filter; and the step of adjusting amplitude and phase of the other channel is performed by a third Q-filter.

19. A system for synthesizing multiple output channels from a stereo input signal, the system comprising:

first circuit for synthesizing a first pair of output signals having monaural information from the stereo input signal; and second circuit for synthesizing a second pair of output signals having monaural information substantially removed from the stereo input signal, wherein said second circuit comprises:

a first filter for adjusting amplitude and phase of the one channel of the stereo signal on a frequency dependent basis to form a first filtered signal;

a second filter for adjusting amplitude and phase of the other channel of the stereo signal on a frequency dependent basis to form a second filtered signal;

a first summer for combining an inverse signal of the second filtered signal with the one channel of the stereo signal to form one signal of the second pair of output signals; and a second summer for combining an inverse of the first filtered signal with the other channel of the stereo signal to form the other signal of the second pair of output signals.

20. The system of claim 19, further comprising:

third circuit for synthesizing a center monaural signal from the stereo input signal.

21. The system of claim 20, wherein the third circuit comprises:

a third summer which combines the stereo input signals to form a first combined signal; and a high pass filter, which is applied to the first combined signal and forms the center monaural signal.

22. The system of claim 19, further comprising:

fourth circuit for synthesizing a sub-woofer signal from the stereo input signal.

23. The system of claim 22, wherein the fourth circuit comprises:

a third summer which combines the stereo input signals to form a first combined signal; and a low pass filter, which is applied to the first combined signal and forms the subwoofer signal.

24. The system of claim 19, wherein the first circuit comprises:

a fourth summer for combining the one channel of the stereo signal with an inverse of the other channel of the stereo signal to form a difference signal;

a third filter for adjusting amplitude and phase of the difference signal on a frequency dependent basis to form a third filtered signal;

a fourth summer for combining the third filtered signal with the one channel to form one signal of the first pair of output signals; and a fifth summer for combining an inverse signal of the third filtered signal with the other channel to form the other signal of the first pair of output signals.

25. The system of claim 24, wherein said third filter for adjusting comprises:

a Q-filter.

26. The system of claim 24, further comprising:

module for switchably controlling an operation of said third filter for adjusting.

27. The system of claim 19, wherein:

said first filter for adjusting comprises a first Q-filter; and said second filter for adjusting comprises a second Q-filter.

28. A method for synthesizing multiple output channels from a stereo input signal, the method comprising the steps of:

synthesizing a first pair of output signals having monaural information from the stereo input signal; and synthesizing a second pair of output signals having monaural information substantially removed from the stereo input signal, wherein the step of synthesizing a second pair of output signals comprises the steps of:

adjusting amplitude and phase of the one channel of the stereo signal to form a first filtered signal;

adjusting amplitude and phase of the other channel of the stereo signal to form a second filtered signal;

combining an inverse signal of the second filtered signal with the one channel of the stereo signal to form one signal of the second pair of output signals; and combining an inverse of the first filtered signal with the other channel of the stereo signal to form the other signal of the second pair of output signals.

29. The method of claim 28, further comprising the step of:

synthesizing a center monaural signal from the stereo input signal.

30. The method of claim 29, wherein the step of synthesizing a center monaural signal comprises the steps of:

combining the stereo input signals to form a first combined signal; and high pass filtering the first combined signal to form the center monaural signal.

31. The method of claim 28, further comprising the step of:

synthesizing a sub-woofer signal from the stereo input signal.

32. The method of claim 31, wherein the step of synthesizing a sub-woofer signal comprises the steps of:

combining the stereo input signals to form a first combined signal; and low pass filtering the first combined signal to form the sub-woofer signal.

33. The method of claim 28, wherein the step of synthesizing a first pair of output signals comprises the steps of:

combining the one channel of the stereo signal with an inverse of the other channel of the stereo signal to form a difference signal;

adjusting amplitude and phase of the difference signal on a frequency dependent basis to form a third filtered signal;

combining the third filtered signal with the one channel to form one signal of the first pair of output signals; and combining an inverse signal of the third filtered signal with the other channel to form the other signal of the first pair of output signals.

34. The method of claim 33, wherein:

the step of adjusting to form said third filtered signal is performed by a first Q-filter.

35. The method of claim 33, further comprising the step of:

switchably controlling a performance of the step of adjusting.

36. The method of claim 28, wherein:

the step of adjusting amplitude and phase of the one channel is performed by a second Q-filter; and the step of adjusting amplitude and phase of the other channel is performed by a third Q-filter.

* * * * *